United States Patent [19]

Piercy et al.

[11] 4,134,507

[45] Jan. 16, 1979

[54] FLEXING BEAM ASSEMBLY

[75] Inventors: Richard J. Piercy, Batavia; Neal L. Woessner, Montgomery, both of Ill.

[73] Assignee: Caterpillar Tractor Co., Peoria, Ill.

[21] Appl. No.: 809,342

[22] Filed: Jun. 23, 1977

[51] Int. Cl.[2] ..... E02F 3/80

[52] U.S. Cl. ..... 214/145 R; 29/150; 52/721; 212/144; 228/165; 228/178

[58] Field of Search ..... 214/131 R, 145 R, 776; 212/144; 52/116, 119, 721, 731, 732; 29/150; 228/165, 168, 178

[56] References Cited

U.S. PATENT DOCUMENTS

| | | | |
|---|---|---|---|
| 1,293,872 | 2/1919 | Murray | 228/165 X |
| 1,760,955 | 6/1930 | Moss | 228/165 X |
| 2,745,169 | 5/1956 | Scheldorf | 29/150 |
| 3,154,199 | 10/1964 | Balogh et al. | 212/144 X |
| 3,575,448 | 4/1971 | Licari | 228/178 X |
| 3,884,378 | 5/1975 | Muellner et al. | 214/776 X |
| 3,947,191 | 3/1976 | Millner | 212/144 X |

*Primary Examiner*—L. J. Paperner

*Attorney, Agent, or Firm*—Charles E. Lanchantin, Jr.

[57] ABSTRACT

A flexing beam assembly includes an elongated beam having a construction sufficient for bending under load and defining a neutral plane of zero stress therethrough, a bracket having first and second ends, an opening through the first end, a load bearing connecting joint formed at the second end, and a weld joint located at the periphery of the opening and contiguously to the neutral plane for securing the bracket to the beam with the second end of the bracket extending outwardly beyond the beam.

10 Claims, 6 Drawing Figures

FLEXING BEAM ASSEMBLY

BACKGROUND OF THE INVENTION

This invention relates generally to a flexing beam assembly having a neutral plane of zero stress therethrough, and more particularly to an improved construction for weldably connecting a load carrying attachment bracket to an elongated bendable beam such as a lift arm assembly for a loader vehicle.

Many material handling loading vehicles include a pair of lifting beams or arms which are pivotally connected at their proximal ends to the frame of the vehicle and at their distal ends to a load carrying implement. Usually, a pair of hydraulic jacks are connected to the frame and to the lift arms intermediate the opposite ends thereof for selectively raising and lowering the implement to accomplish the desired working tasks. With such construction relatively complex connecting joints have evolved to pivotally couple the lifting jacks to the lift arms. Initially, for example, it was a matter of simply welding an inverted yoke member to the bottom of each of the lift arms and transpiercing a pivot pin through the yoke member to complete the coupling to the top of the lift jacks. However, as the size and lifting capacity of the loading vehicles has increased, concentrated stresses have continued to increase around the yoke members. Subsequent cracking and failure of the yoke members or the weld joints that secure them to the lift arms has led to the development of more massive attachment bracket constructions. But these have required so much weld around the peripheral edges of the brackets that the same failure problems have been experienced. Not only have numerous attempts been made to extend the length of the welds, but multiple layers have been utilized. Nevertheless, despite careful blending of the welds, cracking continues to develop at the areas of maximum stress concentration.

SUMMARY OF THE INVENTION

The present invention is directed to overcoming one or more of the problems as set forth above.

According to the present invention this is accomplished by providing a flexing beam assembly which includes an elongated beam having a construction sufficient for bending under preselected loads and defining a neutral plane of zero stress therethrough, a bracket having first and second ends, an opening through the first end, a load bearing connecting joint formed at the second end, and a weld joint extending substantially around the periphery of the opening and being contiguous with the neutral plane for securing the bracket to the beam with the second end of the bracket extending outwardly beyond the beam.

DETAILED DESCRIPTION

Figure 1:
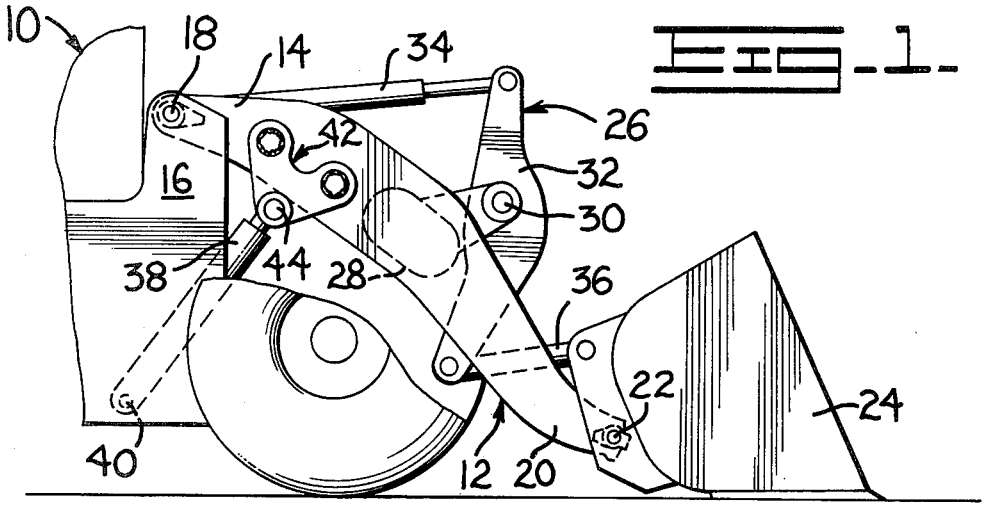
FIG. 1 is a diagrammatic and side elevational view of the forward portion of a loader vehicle embodying the flexing beam assembly of the present invention.
Figure 2:
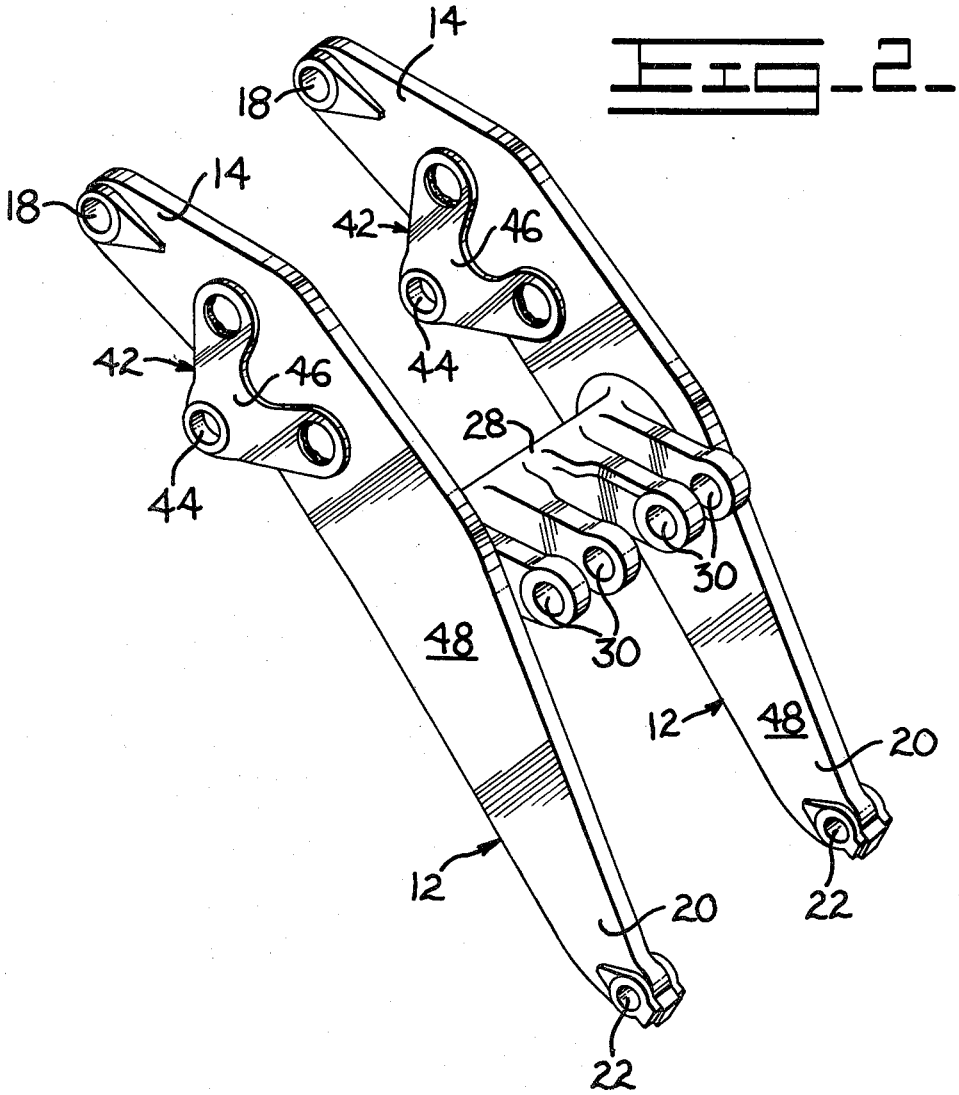
FIG. 2 is an enlarged and diagrammatic perspective view of the flexing beam assembly shown in FIG. 1.

Referring initially to FIGS. 1 and 2, there is shown a portion of a loader vehicle 10 including a pair of side-by-side flexing beam assemblies or lift arms 12 individually constructed in accordance with the present invention. Each of the lift arms has a slight S-curvature in the instant example and has a first or proximal end 14 coupled to a supporting frame 16 at a first pivot joint 18. In the usual manner a second or distal end 20 of the lift arms includes a pivot joint 22 for carrying an implement 24 such as a material carrying bucket. A tilting mechanism, identified generally by the reference numeral 26, is provided to enable selective pivoting of the bucket relative to the lift arms. A cross beam 28 is connected to both of the lift arms and provides a pair of pivot joints 30 for the tilting mechanism. A pair of bellcrank levers 32 are centrally connected to the transversely spaced apart pivot joints 30, are coupled to a pair of fluid operated tilt cylinders or jacks 34 at their upper extremities, and are connected to a pair of lever arms 36 at their lower extremities. Since the tilt cylinders are connected to the supporting frame, the extension or contraction thereof enables selective pivoting of the bucket relative to the lift arms. Since this construction is generally known to the art it need not be further described.

In order to selectively raise and lower the lift arms 12 and thus the bucket 24, a pair of fluid operated lift cylinders or jacks 38 are utilized. These lift cylinders are pivotally coupled to the supporting frame 16 as at a pair of laterally spaced pivot joints 40, and extend upwardly and forwardly therefrom towards the underside of the lift arms to be individually secured thereto through a bracket assembly 42 as at a load bearing pivot joint 44.

Figure 3:
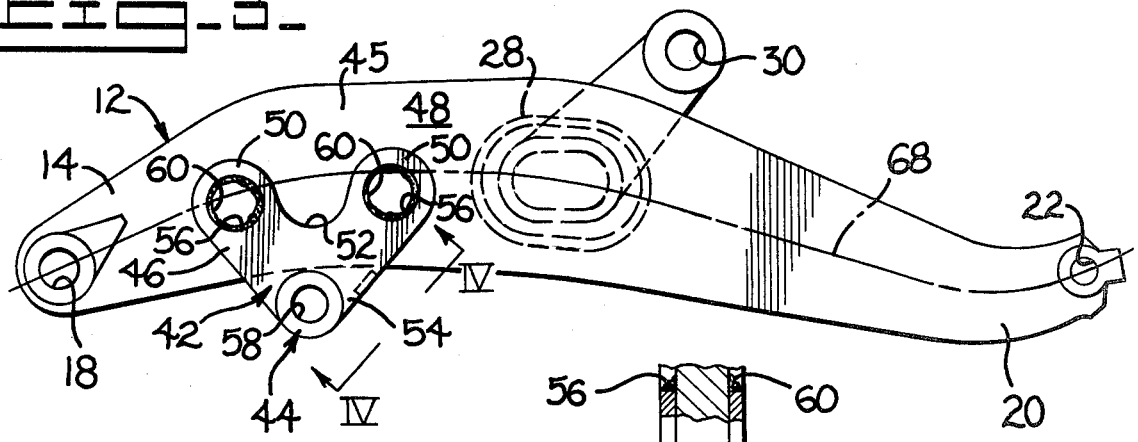
FIG. 3 is a diagrammatic and enlarged side elevational view of the flexing beam assembly illustrated in FIGS. 1 and 2 to further illustrate the relationship of the attachment bracket to the neutral plane of zero stress therethrough.
Figure 4:
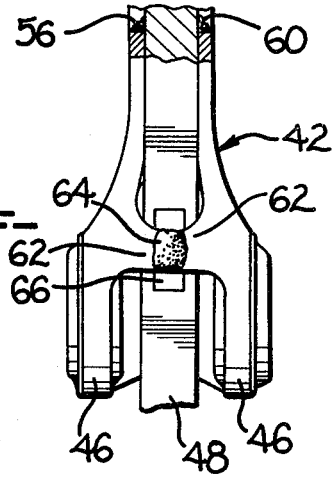
FIG. 4 is a fragmentary and diagrammatic bottom plan view of the attachment bracket shown in FIG. 3 as taken along the line IV—IV thereof.

Referring now to FIGS. 3 and 4, the improved construction for connecting one of the pair of similar bracket assemblies 42 to an intermediate section 45 between the opposite ends 14 and 20 of the lift arms 12 will now be described. Preferably, each of the bracket assemblies includes a pair of juxtaposed U-shaped brackets 46 which are secured to the opposite sides of an elongated, planar and flexing lift arm beam 48. As best shown in FIG. 4, it is to be appreciated that the brackets 46 cooperate in pairs and are substantially mirror images of one another. More specifically, each of the brackets has a pair of upstanding arms 50 at its inwardly extending end, an arcuate recess or groove 52 substantially symmetrically between the arms, and a depending apex 54 at its outwardly extending end. A round or substantially cylindrical opening 56 is provided in each of the arms and another opening 58 is formed through the apex thereof to complete a portion of the load bearing pivot joint 44. Preferably, only a single weld joint or an annular fillet weld 60 extends substantially around the periphery of each of the openings 56 to secure each of the brackets 46 to the beam 48.

As shown in FIG. 4 each of the juxtaposed brackets 46 has a transversely extending arm 62 on its outwardly extending end. These arms are interconnected by a fillet weld 64 through the addition of a suitable backup plate 66.

Referring again to FIG. 3, in accordance with the theory of flexure of a bending beam any upward force on the pivot joint 44 and downward load on the pivot joint 22 would cause the upper or convex side of the beam 48 to be in tension while the lower or concave side of the beam would be in compression. Under these conditions a neutral plane of zero stress 68 is defined between the top and bottom of the beam for substantially the full length thereof is indicated by the phantom line in the drawing. According to one of the major features of the present invention the openings 56 and the fillet welds 60 utilized to connect the individual brackets 46 to the beam 48 are located contiguous with such neutral plane. This minimizes the maximum stresses in the weld joints and leads to a greatly increased fatigue life thereof. In actual experimental tests it was determined that the brackets should preferably be secured to the beam solely through the annular fillet welds 60 because additional welds located around the periphery of the brackets, not shown, were subject to fatigue cracking substantially proportionately to the distance of such welds away from the neutral plane 68. It was also theorized that in the preferred embodiment the upwardly facing arcuate recess 52 between the arms 50 provided additional freedom of movement in flexing ability in the bracket assembly 42 which substantially increased the fatigue service life thereof.

Figure 5:
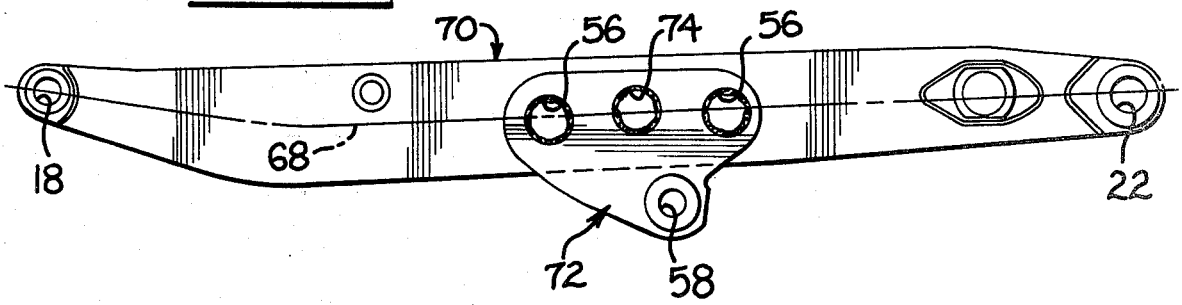
FIG. 5 is a diagrammatic side elevational view of an alternate embodiment flexing beam assembly constructed in accordance with the present invention.

An alternate embodiment flexing beam assembly or lift arm 70 is illustrated in FIG. 5 which shares in many respects the general construction of the preferred lift arm 12, including the neutral plane 68, but differs primarily in the generally inverted triangular construction of a bracket assembly 72. Rather than having a pair of the arcuate recesses 52 as described in connection with the preferred embodiment, such bracket assembly includes a third or central opening 74 on each side of the lift arm intermediate the other two openings 56 corresponding to those illustrated in the preferred embodiment. Each of the annular fillet welds 60 in the openings 56 and 74 is, however, overlappingly again advantageously disposed with respect to the neutral plane 68.

Figure 6:
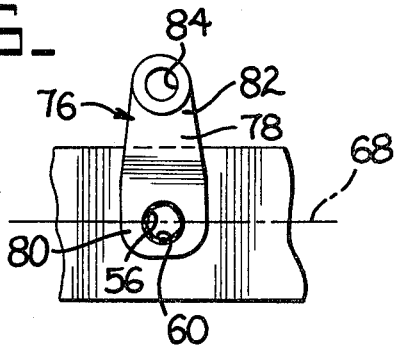
FIG. 6 is a fragmentary and diagrammatic side elevational view of a second alternate embodiment flexing beam assembly.

A second alternate embodiment flexing beam assembly 76 of simplified construction is shown in FIG. 6. In such embodiment a pair of upstanding brackets 78 are utilized, with each bracket being secured to the opposite sides of the beam in a mirror image manner. Each bracket has a first or attachment end 80 and a second or connecting joint end 82. In a manner similar to that described above, the first end includes only a single opening 56 therethrough and a single fillet weld 60 therearound overlappingly located on the neutral plane 68. Its outwardly extending end includes a load bearing connecting joint 84 of the usual type for transmitting forces from an external element, not shown, to the beam.

It is thus apparent that the flexing beam assemblies of the present invention include pairs of cooperating brackets which are each secured to a flexing beam solely through an annular fillet weld contiguous with the neutral plane of the beam. With such construction it is actually undesirable to employ additional welds intermediate the periphery of the brackets and the beam. Through experimental stress analysis and fatigue tests it has been determined that a flexible beam embodying the construction of the present invention has an extended service life in use. This is achieved at minimum waste because of the relatively limited amount of welding necessary to accomplish the connecting task.

Other aspects, objects and advantages of this invention can be obtained from a study of the drawings, the disclosure, and the appended claims.

The embodiments of the invention in which an exclusive property or privilege is claimed are defined as follows:

1. A flexing beam assembly comprising:
   - an elongated beam having a construction sufficient for bending under preselected loads and defining a neutral plane of zero stress therethrough;
   - a bracket having first and second ends, a round opening through said first end, and a load-bearing connecting joint formed at said second end; and
   - a weld joint extending substantially around the periphery of said round opening, overlapping said neutral plane, and securing the bracket to the beam, said second end of the bracket extending outwardly beyond the beam.

2. The flexing beam assembly of claim 1 wherein said beam is a lift arm for a loading vehicle.

3. The flexing beam assembly of claim 2 wherein said first end of the bracket has a second round opening therethrough, said first and second round openings being spaced apart and overlapping said neutral plane, and said bracket is secured to the beam by an annular weld joint at each of said openings.

4. The flexing beam assembly of claim 1 wherein said bracket is of generally U-shaped construction having a pair of arms, an arcuate recess between said arms, and an apex opposite said recess.

5. The flexing beam assembly of claim 1 wherein said bracket has a plurality of round openings through said first end, said round openings being spaced apart and overlapping said neutral plane.

6. The flexing beam assembly of claim 5 including an annular fillet weld joint at each of said round openings in the bracket.

7. A lift arm assembly for a loader vehicle comprising:
   - a lift arm having first and second ends, an intermediate section between said ends, and a neutral plane of zero stress therethrough;
   - means for pivotally coupling said first end of said lift arm to said vehicle;
   - means for attaching an implement to said second end of said lift arm;
   - a bracket having first and second ends and a round opening through said first end;
   - lifting means connected to said vehicle and to said second end of the bracket for raising and lowering said lift arm; and
   - a weld joint extending about the periphery of said round opening, overlapping said neutral plane, and connecting the bracket to said intermediate section of the lift arm.

8. The lift arm assembly of claim 7 wherein said bracket is of U-shaped configuration including a pair of upstanding arms on said first end, one of said arms having said first round opening therethrough and the other one of said arms having a second round opening therethrough, and wherein said weld joint includes an annular fillet weld around each of said openings located overlappingly on said neutral plane.

9. The lift arm assembly of claim 7 wherein said bracket is generally of an inverted triangle configuration with a plurality of said round openings through the bracket at said first end, said bracket being connected to said lift arm solely through a plurality of said weld joints overlapping said neutral plane.

10. In a flexing beam assembly of the type including an elongated beam having a construction sufficient for bending under preselected loads and defining a neutral plane of zero stress therethrough, and a bracket having first and second ends and a load-bearing connecting joint formed at said second end extending outwardly beyond the beam, the improvement comprising:

a plurality of round openings through said first end of said bracket; and an annular weld joint extending around each of said round openings, overlapping said neutral plane, and securing the bracket to the beam.

* * * * *